US006889771B1

(12) United States Patent
Leising et al.

(10) Patent No.: US 6,889,771 B1
(45) Date of Patent: May 10, 2005

(54) SELECTIVE DIRECT AND REVERSE CIRCULATION CHECK VALVE MECHANISM FOR COILED TUBING

(75) Inventors: Lawrence J. Leising, Missouri City, TX (US); Robert M. Ramsey, Missouri City, TX (US); Howard L. McGill, Lufkin, TX (US); Peter V. Smith, Sugar Land, TX (US)

(73) Assignee: Schlumberger Technology Corporation, Sugarland, TX (US)

( * ) Notice: Subject to any disclaimer, the term of this patent is extended or adjusted under 35 U.S.C. 154(b) by 23 days.

(21) Appl. No.: 10/254,134

(22) Filed: Sep. 25, 2002

Related U.S. Application Data

(60) Provisional application No. 60/399,255, filed on Jul. 29, 2002.

(51) Int. Cl.[7] ..... E21B 34/06

(52) U.S. Cl. ..... 166/373; 166/331; 166/317; 166/319

(58) Field of Search ..... 166/373, 317, 166/318, 319, 321, 328, 329, 331, 332.4, 166/332.8, 325

(56) References Cited

U.S. PATENT DOCUMENTS

| | | | | |
|---|---|---|---|---|
| 4,161,985 A | | 7/1979 | Fournier et al. | |
| 4,276,937 A | | 7/1981 | Calhoun et al. | |
| 4,458,762 A | | 7/1984 | McMahan | |
| 4,729,432 A | * | 3/1988 | Helms | 166/317 |
| 4,846,281 A | * | 7/1989 | Clary et al. | 166/373 |
| 5,253,712 A | | 10/1993 | Swor | |
| 5,285,850 A | | 2/1994 | Bayh, III | |
| 5,411,096 A | * | 5/1995 | Akkerman | 166/321 |
| 6,209,663 B1 | * | 4/2001 | Hosie | 175/57 |
| 6,311,775 B1 | * | 11/2001 | Allamon et al. | 166/285 |
| 6,446,727 B1 | | 9/2002 | Zemlak et al. | |

OTHER PUBLICATIONS

"In-Line Centralizer", Petro Tech Tools, Inc., 1999, 2 pages.
"Bypass Double Flapper Check Valve", Petro-Tech Tools, Inc., 1999, 3 pages.
"Standard Toolstring Components—Safety Valves", Pressure Control Engineering, 1 page.

* cited by examiner

*Primary Examiner*—Kenn Thompson
(74) *Attorney, Agent, or Firm*—Robin Nava; Brigitte Echols

(57) ABSTRACT

A method and apparatus for selectively actuating a dual check valve assembly within a well for a direct circulating operational mode or a reverse circulating operational mode. A tubular housing which may be connected to well tubing is provided with a check valve assembly and may be provided with a rotatable J-slot mode indexing sleeve having an internal J-slot geometry. An inner tubular member which also may be connected to well tubing is linearly movable within the tubular housing to a valve open position, an indexing position and a valve enabled position being controlled by the J-slot geometry of the J-slot indexing sleeve or being controlled by moving the inner tubular element and resisting movement of the tubular housing. Relative positioning of the inner tubular member and the tubular housing to selective valve mode positions may also be achieved responsive to fluid flow, by mechanical compression, or by motion operation.

24 Claims, 10 Drawing Sheets

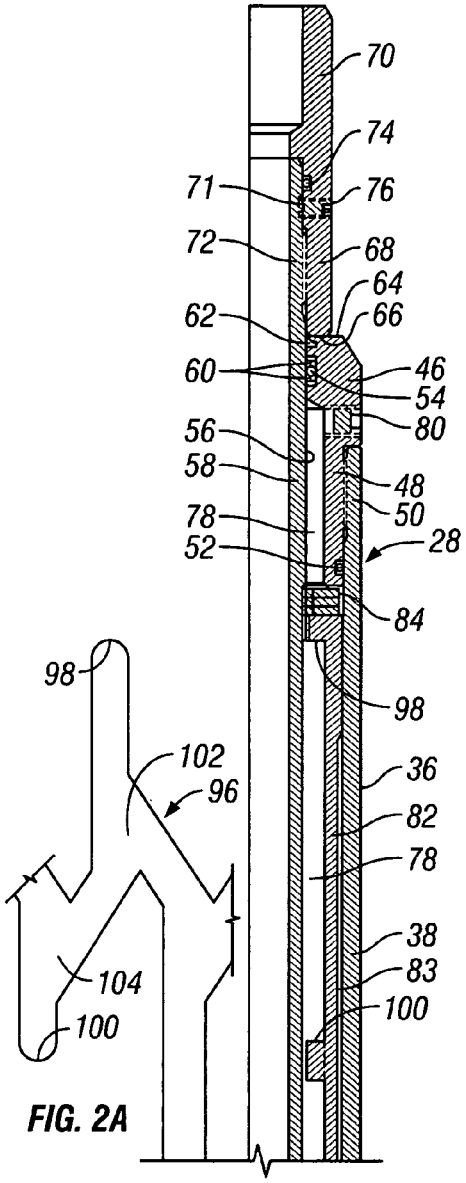
FIG. 2A
FIG. 2
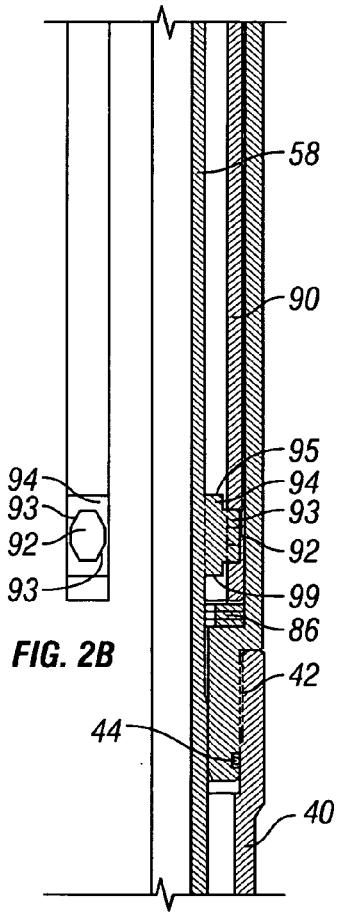
FIG. 2B
FIG. 3

SELECTIVE DIRECT AND REVERSE CIRCULATION CHECK VALVE MECHANISM FOR COILED TUBING

CROSS REFERENCE TO RELATED APPLICATIONS

This application claims priority from U.S. Provisional Application 60/399,255, filed Jul. 29, 2002, which is incorporated herein by reference.

BACKGROUND OF THE INVENTION

1. Field of the Invention

The present invention relates generally to check valve systems that are typically required by industry standards for coiled tubing well interventions. More specifically, the present invention concerns a check valve system having the capability of being controlled by selective mechanical cycling movement or flow responsive movement of tool components to permit controlled selection of a direct circulating flow mode or a reverse circulating flow mode, thus permitting the check valve tool to assist in the performance of servicing operations such as sand cleanout or well flow up a section of, or the entire, coiled tubing string.

2. Description of Related Art

It is a safety standard in coiled tubing operations to have a check valve with a minimum of two pressure barriers in the tool string. In many coiled tubing operations, such as fracturing and well cleanout operations, it is desirable to reverse circulate through the coiled tubing. Reverse circulating (flowing upwardly within the passage of the coiled tubing, instead of downwardly) is not possible when conventional dual check valves are employed.

BRIEF SUMMARY OF THE INVENTION

It is a principal feature of the present invention to provide a novel check valve mechanism or tool for use in well applications, particularly when the tubing being utilized within the well is coiled tubing, to accommodate industry safety standards and to selectively control the check valve mechanism for both direct circulation flow and reverse circulation flow.

It is another feature of the present invention to provide a novel dual check valve mechanism or tool which, with pipe manipulation, i.e., up and down movement, can accomplish selective indexing of a J-slot indexing mechanism for converting the valve mechanism to a direct circulation mode and reverse circulation mode.

It is also within the scope of the present invention to provide a novel dual check valve mechanism or tool which may take the form of any of several different operational embodiments, including drag spring induced operation, motion induced operation, cycle induced operation, flow induced operation, and compression induced operation.

It is another feature of the present invention to provide a novel dual check valve mechanism or tool which can be simply and efficiently re-configured from direct circulation flow to reverse circulation flow as desired for specific well service activities that are ordinarily not possible with conventional dual check valve mechanisms, and can be quickly restored to a safe condition for direct circulating flow only by using a drop ball/pressure induced override procedure or tension to actuate the dual check valves for closing responsive to reverse circulating flow.

Briefly, the various objects and features of the present invention are realized by providing a controllable reversing valve mechanism which has a mode for direct circulating flow and is actuated for reverse flow by cyclic up and down motion of tubular well tool components to achieve relative positioning of the tool components. Selective actuation, indexing, or positioning of the tubular components of the dual check valve mechanism between a direct circulating flow mode and a reverse circulating flow mode is achieved by simple relative linear movement of tool components or by a J-slot positioning indexing mechanism to selectively accomplish normal downward check valve controlled fluid flow and to achieve a flow condition permitting upward or reverse flow of fluid from the annulus of the well through the tool bore. The preferred embodiment of the present invention is a drag spring reversing valve which provides the number and arrangement of check valves that are required by industry standards and, with pipe manipulation, actuates the valve mechanism for reverse circulation as well as direct circulation, then with further pipe or tubular component manipulation, reverts the check valve mechanism to its direct circulation mode, allowing only direct circulation.

When the reverse circulating flow path is open, direct and reverse flow are possible. When the direct circulating flow path (flow down the inside of the coiled tubing) is open, only direct circulation is possible. Due to the risk of bringing unknown production fluids up the coiled tubing to the surface, reverse flow is typically not allowed unless an exemption is granted. An application for the present invention is in wells where a reverse flow sand cleanout is performed down to sand within the well casing that is typically 100 feet (30.5 meters) above the casing perforations.

Reverse circulating flow well cleanout procedures with the reversible dual check valve tool of the present invention use the high velocity fluid inside the coiled tubing to transport sand, whereas with direct flow the velocity of the fluid between the coiled tubing and the casing is much lower and often an expensive foam cleanout is required to entrain the sand under lower velocity flow conditions and transport the sand to the surface. Thus, reverse circulation flow is preferable for sand removal from wells. During reverse circulating flow the annulus of the well is pressurized from the surface. With the ability to close the check valve and with the well kept overbalanced by tubing or casing pressure that exceeds formation pressure, reverse circulation can be performed closer to the perforations of the well casing than is presently allowed under industry safety standards.

The drag spring actuated dual check valve tool, which is the preferred embodiment of the present invention can be configured for two operating modes:

1. Motion operated mode—In this mode the J-slot sleeve is removed from the tool. With removal of the J-slot sleeve, drag spring resistance shifts the tool to the reverse circulating mode with downward motion and to the direct circulating mode with upward motion. Downward motion of the coiled tubing shifts the housing upward and the tube forces the check valves open, thus permitting direct circulation or reverse circulation through the dual check valve mechanism. Upward motion of the coiled tubing moves the housing down and causes the check valves to be enabled, thus preventing reverse flow.
2. Cycle operated mode—A rotating J-slot sleeve/spline mechanism, with up and down manipulation of the coiled tubing is used to move the dual flow path valve between direct and reverse circulating modes. While running into the hole, the tool will usually be prepared in direct circulating mode, with the reverse circulating flow path closed and the check valves enabled for flow responsive operation. At depth the pipe or coiled tubing is picked up and lowered again which cycles the J-slot sleeve/spline mechanism from the direct circulating mode to the reverse circulating mode. Each subsequent up and down cycle moves the dual flow path between the direct-reverse-direct circulating modes. When the tool is in the reverse circulating mode the check valves are held open by an internal tube. When the tool is shifted to the direct circulating mode the tube is pulled out of the check valve area and the check valves are again enabled. The position of the tool can be verified by pressurizing the annulus and checking the pressure of the coiled tubing. If the passage of the coiled tubing becomes pressurized by annulus pressure, the reversing position is confirmed. In either of the operating modes of the tool, upward movement of the coiled tubing will close the reverse circulating flow path and open the direct circulating flow path, thus enabling the check valves for flow responsive opening and closing. The J-slot position indexing sleeve is grease filled via a port having a pipe plug and is rotatably supported by thrust bearings to minimize its rotational friction within the tubular housing of the tool. The J-slot sleeve has a grooved or slotted interior and defines an internal J-slot geometry that is tracked by a J-pin that projects externally from an inner tubular member that has a portion thereof located for linear movement within the tubular housing.

The J-slot pin itself does not act as a stop in any of the three positions of the tool; rather, it establishes a guiding relation for relative linear movement of the tubular housing and inner tubular member and it causes rotational indexing of the J-slot sleeve responsive to linear upwardly and downwardly cycling movement of the tool components. Compression load is taken by the facing shoulders 64 and 66 between the connector fitting 70 and the primary seal carrier fitting 46. Tension load is taken by J-pin mount shoulder 95, shown in FIG. 3, to J-slot sleeve shoulder 98, shown in FIG. 2. Intermediate position run in hole compression load is taken by J-pin mount shoulder 99, shown in FIG. 3, to J-slot sleeve shoulder 100, shown in FIG. 2. The J-pin mount may be welded to the mandrel or may be machined from solid bar stock.

According to the preferred embodiment, an up and down cycle of the coiled tubing is necessary to move the J-slot sleeve between reverse circulating and direct circulating flow paths. In the cycle operated mode, while running the tool into a well, the reverse circulating flow path is typically closed. Often, while running the tool into the hole, a pull test is done to check mechanical friction between the coiled tubing and the wellbore, thus the tool must be cycled twice to return to the direct flow position. At the desired depth the tool string is picked up, then lowered again, which opens the reverse circulating flow path. Another up and down cycle of the coiled tubing closes the reverse circulating flow path. The alternating operation is accomplished via the J-slot position indexing geometry of the J-slot sleeve of the tool. The operator may choose to run the tool into the hole with either the direct or reverse circulating flow path initially open. When the reverse circulating flow path is open, direct and reverse flow is possible. When the reverse circulating flow path is closed, only direct circulation is possible.

According to the preferred embodiment of the present invention one or more drag springs are employed to provide the driving force for both the motion operated and cycle operated modes. The drag spring must have adequate force to operate the mechanism in the well casing, typically 4.1 to 6.4 inches (104 to 163 mm) inner diameter. The drag spring is designed to have a low spring rate in order to limit the drag force passing through the pipe nipple, typically 3.725 inches (95 mm) inner diameter. The drag spring is also designed to be in tension either running the tool into the hole or pulling the tool out of the hole. This is accomplished by stops on the drag spring support mandrel. The stops are chamfered and knurled in order to ensure the housing does not rotate while the J-slot sleeve is being rotatably indexed during linear cycling of the tubular housing and the inner tubular member.

To separate a portion of the inner tubular member and remove it from its valve open position within the valve housing of the tool, the disconnect type check valve mechanism can be coupled to a pressure responsive drop ball type force responsive disconnect or a tensile, i.e., pulling force responsive, type of disconnect. The dual check valve tool can also be coupled to a pressure operated disconnect, causing disconnection to occur responsive to pressure injection through the coiled tubing. This disconnect type check valve mechanism can also be used for coiled tubing fracturing operations currently operating under a safety exemption allowing operation without check valves. The disconnect type check valve mechanism can quickly and simply restore the valve mechanism to its direct circulating mode and thereby enhances the safety of the tool during acid fracturing operations. Also, the disconnect mechanism of the tool can function at any position of the tubular housing and inner tubular member.

BRIEF DESCRIPTION OF THE DRAWINGS

So that the manner in which the above recited features, advantages, and objects of the present invention are attained can be understood in detail, a more particular description of the invention, briefly summarized above, may be had by reference to the embodiments thereof illustrated in the appended drawings, which drawings are incorporated as a part hereof.

It is to be noted however, that the appended drawings illustrate only typical embodiments of this invention and are therefore not to be considered limiting of its scope, for the invention may admit to other equally effective embodiments.

In the Drawings:

FIG. 1 is longitudinal sectional illustration showing a well completed to a production formation and showing coiled tubing handling apparatus at the surface with coiled tubing being run into the well and provided with a check valve mechanism adapted for selective actuation according to the principles of the present invention for reverse flow through the valve mechanism;

FIG. 2 is a longitudinal sectional view of an upper section of the check valve mechanism of FIG. 1 showing the upper portion of the J-slot actuating mechanism thereof;

FIG. 2A is a diagrammatic illustration of an upper portion of the J-slot geometry that is shown in association with the J-slot sleeve of the dual check valve mechanism;

FIG. 2B is a diagrammatic illustration of the lower portion of the J-slot geometry;

FIG. 3 is an intermediate longitudinal sectional view of the check valve mechanism of FIG. 1 showing the lower portion of the J-slot actuating mechanism thereof;

FIG. 4 is another intermediate longitudinal sectional view of the check valve mechanism of FIG. 1 showing the dual check valves thereof in detail;

FIG. 5 is a longitudinal sectional view of a lower portion of the check valve mechanism of FIG. 1 showing a drag spring supported for limited linear movement by the dual check valve mechanism and having frictional engagement with the well casing to provide a motive force for actuating the J-slot actuating mechanism thereof;

FIG. 6 is a longitudinal sectional view of the upper section of a dual flow reversible check valve mechanism embodying the principles of the present invention and being adapted for flow responsive indexing for direct and reverse circulation modes;

FIG. 7 is a longitudinal sectional view of the intermediate section of the dual flow reversible check valve mechanism of FIG. 6;

FIG. 7A is a partial diagrammatic layout illustration of the J-slot geometry of the J-slot sleeve of FIG. 7;

FIG. 8 is a longitudinal sectional view of the lower section of the dual flow reversible check valve mechanism of FIGS. 6 and 7;

Figure 6:
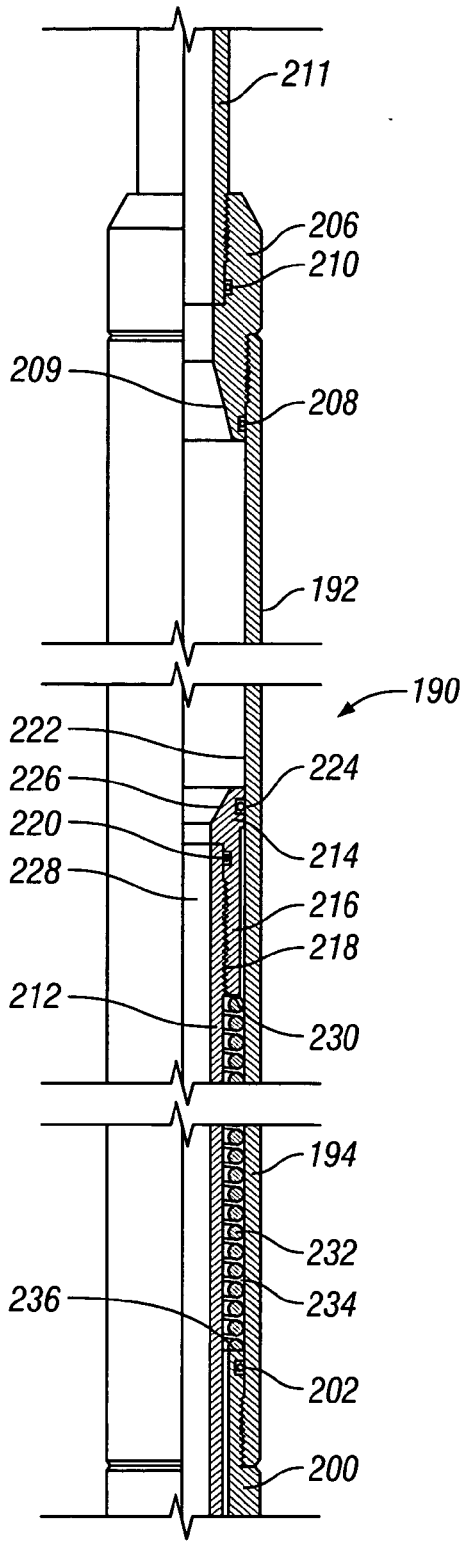
Figure 7A:
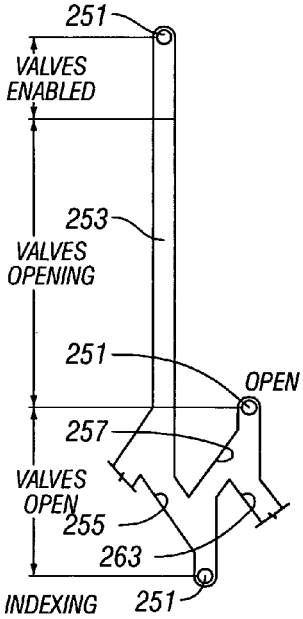
Figure 7:
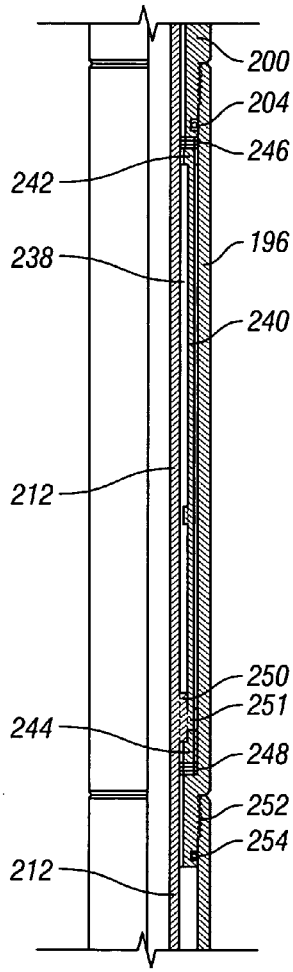
Figure 8:
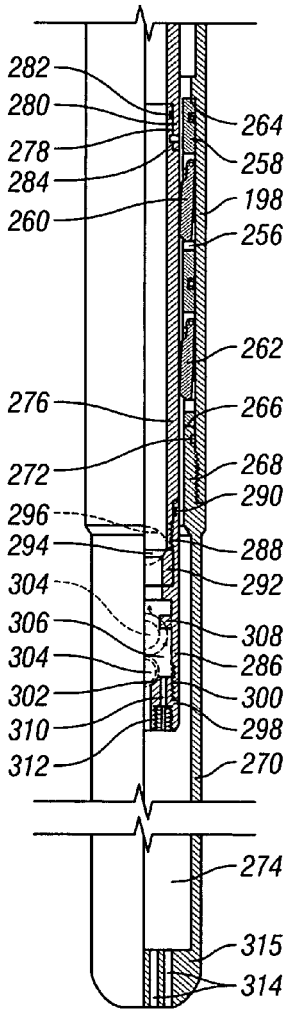
Figure 9:
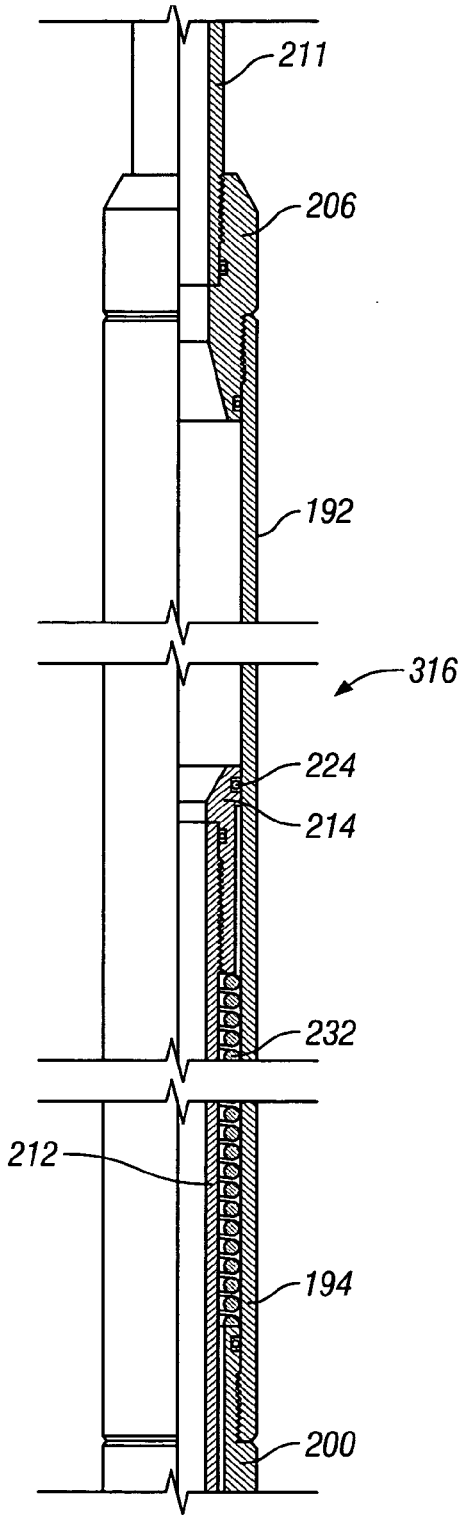
Figure 10A:
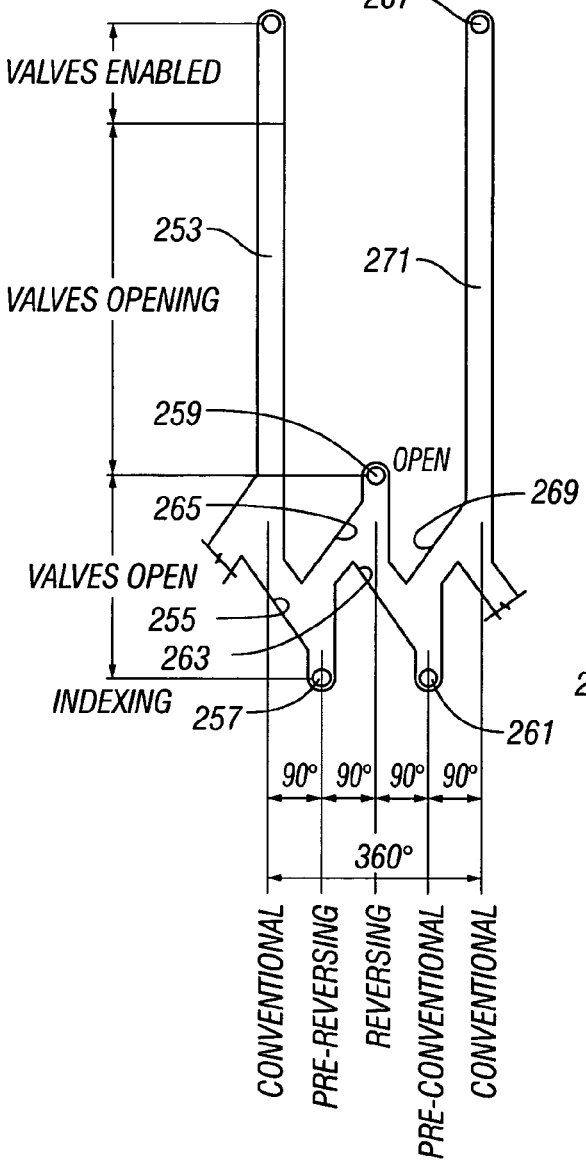
Figure 10:
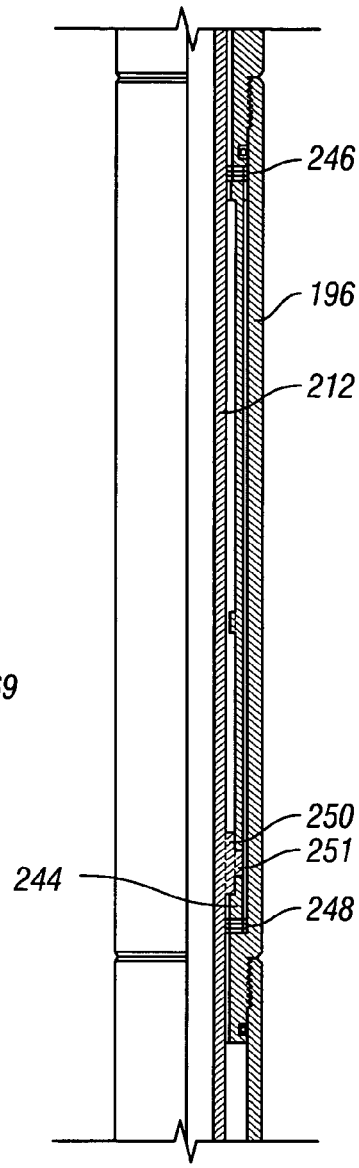
Figure 11:
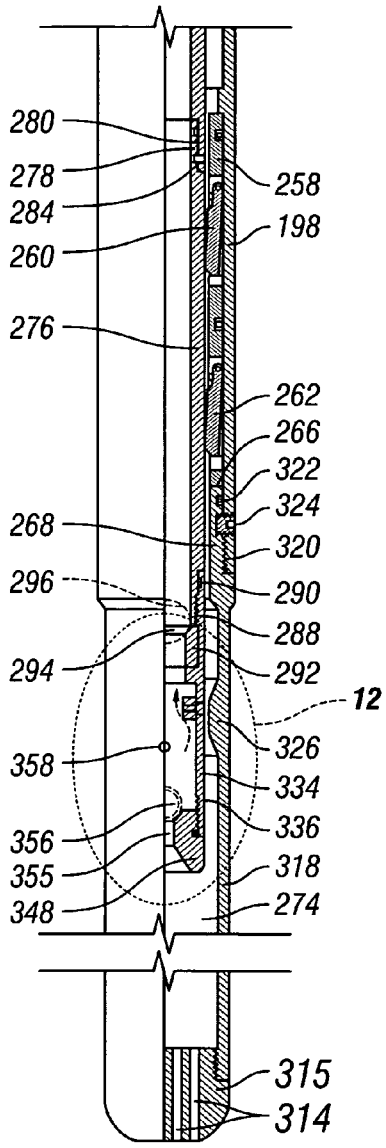
Figure 12:
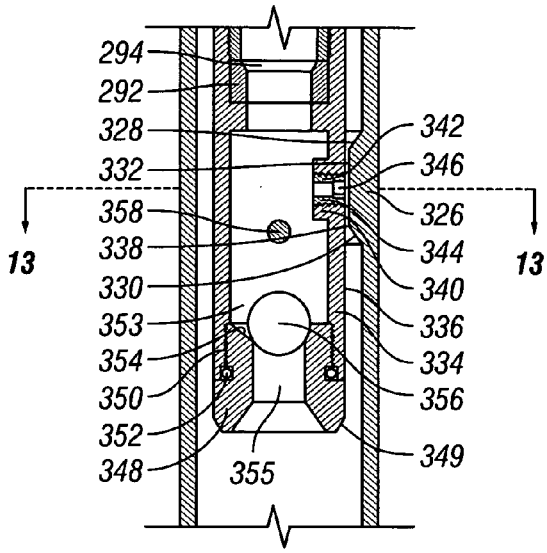
Figure 13:
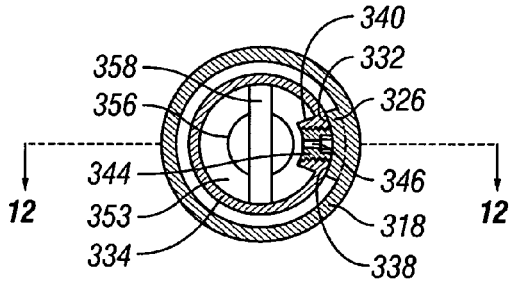
Figure 15A:
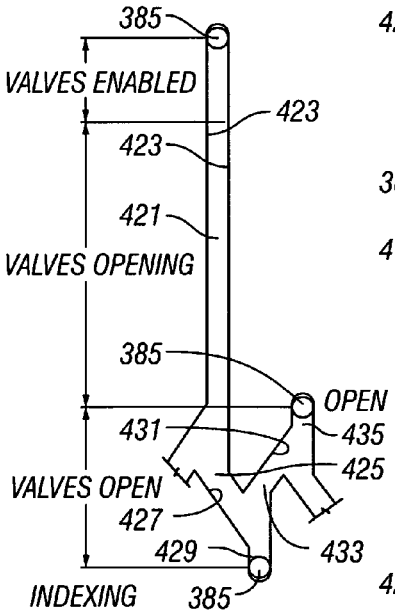
Figure 15:
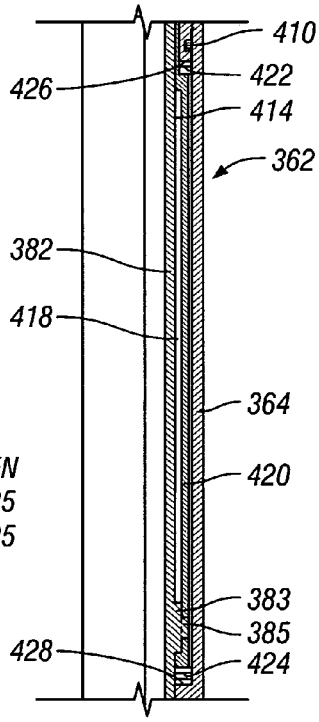
Figure 14:
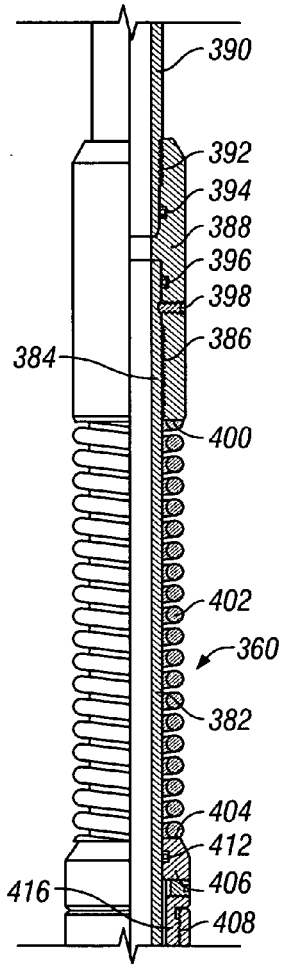
Figure 16:
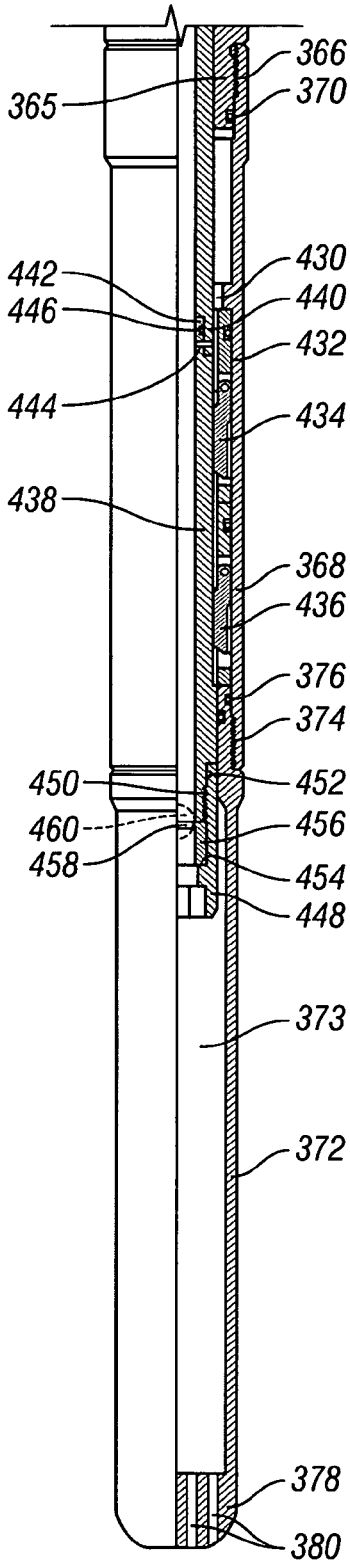

FIG. 9 is a longitudinal sectional view of the upper section of a dual flow reversible check valve mechanism embodying the principles of the present invention and being adapted for flow responsive indexing for direct and reverse circulation modes in similar manner as shown in FIGS. 6–8;

FIG. 10 is a longitudinal sectional view of the intermediate section of the dual flow reversible check valve mechanism of FIG. 9;

FIG. 10A is a diagrammatic layout illustration of the J-slot geometry of the J-slot sleeve of FIG. 10;

FIG. 11 is a longitudinal sectional view of the lower section of the dual flow reversible check valve mechanism of FIGS. 9 and 10;

FIG. 12 is an enlarged sectional view showing a portion of the lower section of the dual flow reversible check valve mechanism of FIGS. 9–11;

FIG. 13 is a sectional view taken along line 13—13 of FIG. 12;

FIG. 14 is a longitudinal sectional view of the upper section of a compression actuated dual flow reversible check valve mechanism representing another alternative embodiment of the present invention;

FIG. 15 is a longitudinal sectional view of an intermediate section of the dual flow reversible check valve mechanism of FIG. 14;

FIG. 15A is a partial layout illustration of the J-slot valve indexing geometry of the J-slot sleeve shown in FIG. 15; and FIG. 16 is a longitudinal sectional view of the lower section of the dual flow reversible check valve mechanism of FIGS. 14 and 15.

DETAILED DESCRIPTION OF THE INVENTION

Figure 1:
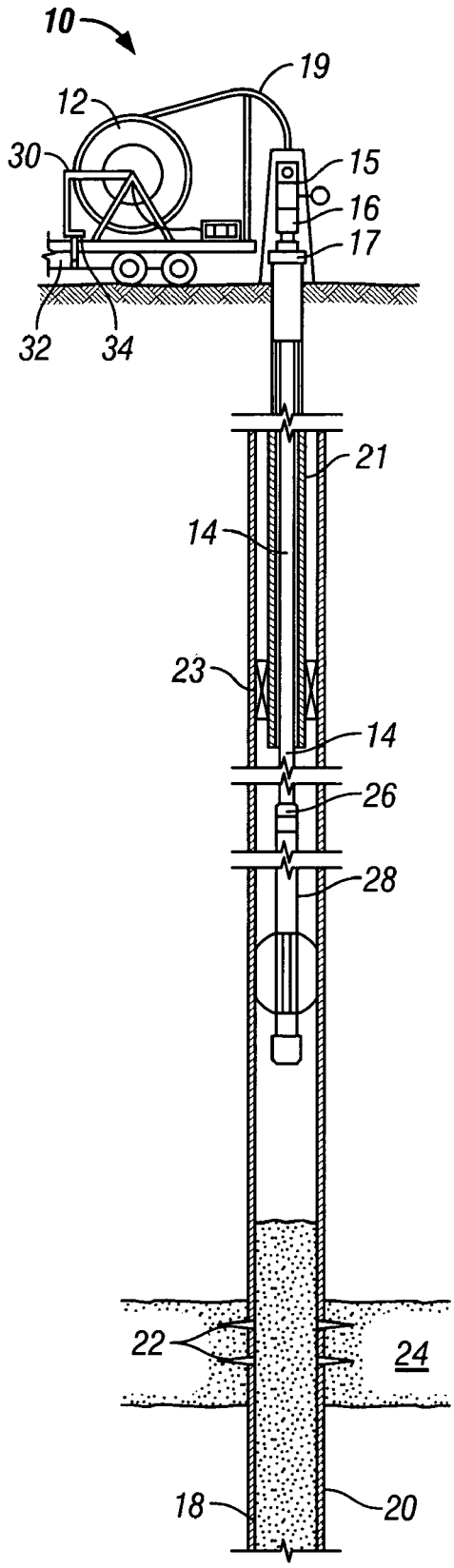
Figure 4:
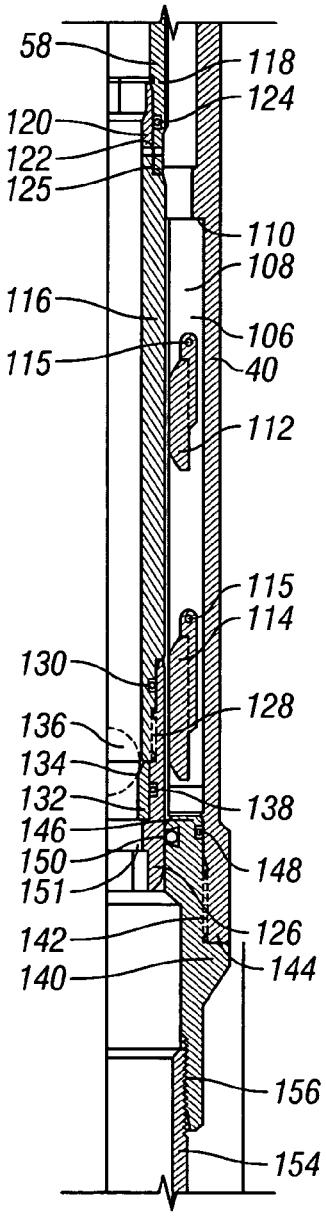
Figure 5:
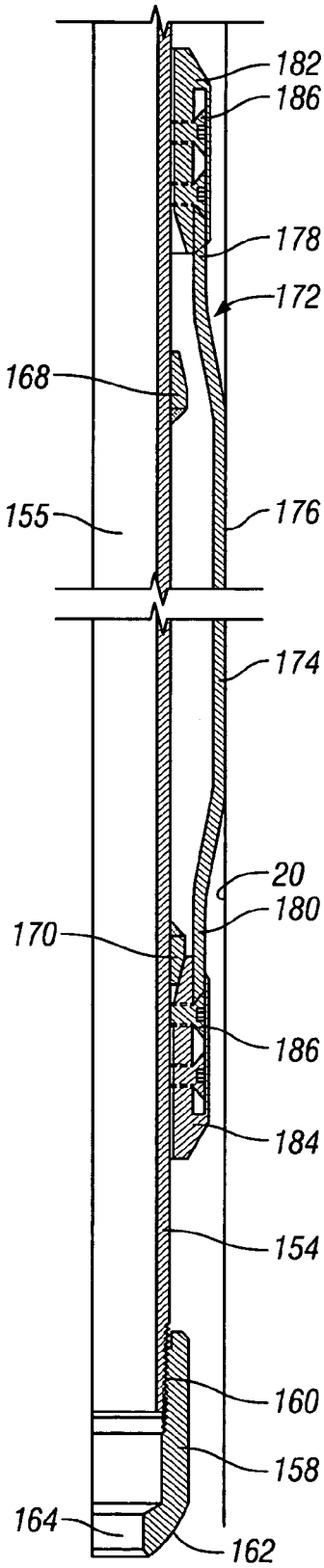

Referring now to the drawings and first to FIG. 1, a trailer or truck mounted mobile coiled tubing mechanism is shown generally at 10 and incorporates a tubing storage reel 12 from which coiled tubing 14 is run by an injector 15 through a blowout preventer 16 and a wellhead 17 and into a well 18. The coiled tubing from the reel 12 passes along a guide 19 as it is moved into the well 18 by the injector 15. A length of production tubing 21 is supported by a hanger within the wellhead 17, with its lower end being sealed to the well casing 20 by a packer 23. The casing 20 is perforated at 22 to permit communication of the well with a production formation 24, from which petroleum products such as crude oil, natural gas, distillate and typically also water are produced. The coiled tubing 14 extends through the production tubing 21 to a desired depth within the well, typically a location above the casing perforations. A connector 26 is provided at the lower end of the coiled tubing 14 and provides for connection of a through-tubing type reversible check valve tool, shown generally at 28, which embodies the principles of the present invention.

For injection of fluid through the coiled tubing and dual check valve mechanism and into the well, a conduit 30 is connected to the centermost coil of the coiled tubing on the storage reel 12 and permits fluid from a supply tank 32 to be pumped through the coiled tubing by a pump 34. For reverse well cleanout operations fluid in the annulus between the well casing and tubing is pressurized from the surface. This pressurized fluid, by virtue of the small diameter of the well tubing, typically coiled tubing, substantially increases in velocity as it enters the coiled tubing. This increased velocity fluid flow easily entrains and transports sand through the tubing to the surface for disposal.

As mentioned above, it is desirable to provide a controllable dual check valve tool to meet technical requirements and to provide for reverse circulating flow through the check valve mechanism as needed for well cleanout service and for other well service procedures. Referring now to FIGS. 2–5, a preferred embodiment of the present invention, shown generally at 28 in FIGS. 1 and 2, effectively accomplishes these features. The through-tubing type flow reversing dual check valve tool 28, shown in FIGS. 2–5 is also referred to as a "drag spring reversing valve". The drag spring reversing valve provides the number and arrangement of check valves that are required by industry standards and, with pipe manipulation, allows both direct circulation flow and reverse circulation flow, then with further pipe manipulation, reverts the check valve mechanism to its "Enabled" condition to allow only direct circulation flow to occur. The reversible dual check valve tool 28 is defined by a tubular housing 36 having upper and lower housing sections 38 and 40 that are assembled by a threaded connection 42, with an O-ring seal 44 establishing sealing at the connection. At its upper end, the tubular housing 36 is provided with a tubular primary seal carrier fitting 46 having a threaded extension 48 that is received by an internal threaded section 50 of the upper housing section 38 and is sealed thereto by an O-ring seal 52. A primary seal 54 is supported by the fitting 46 and is disposed in sealing engagement with the outer cylindrical surface 56 of an inner tubular member 58 that is linearly movable relative to the tubular housing 36, with a portion thereof being received in telescoping relation within the tubular housing 36. A pair of anti-extrusion rings 60 ensure against pressure induced extrusion of the primary seal 54 due to high pressure differential that may occur across the primary seal 54 as the tubular housing 36 and inner tubular member 58 are moved linearly relative to one another. An annular scraper element 62, carried by the primary seal carrier fitting 46, also engages the outer cylindrical surface 56 of the inner tubular member 58 and serves to prevent or minimize contaminant intrusion into the sealing interface of the primary seal with the inner tubular member.

The upper end of the primary seal carrier fitting 46 defines an annular upwardly facing stop shoulder 64 that is disposed for movement limiting engagement with a downwardly facing annular shoulder 66 which is defined by an internally threaded extension 68 of a connector fitting 70 which receives an upper threaded section 72 of the inner tubular member 58. The connector fitting 70 is sealed to the inner tubular member 58 by an O-ring seal 74 and provides a connection between the check valve tool 28 and the coiled tubing 14. To ensure against inadvertent rotation of the connector fitting 70 with respect to the inner tubular member 58, and thus ensure retention of the dual check valve tool mechanism by the coiled tubing, a set screw or plug 76 is threaded through a hole in the connector fitting 70, with the inner end of the set screw or plug being received within a depression (typically a groove) or receptacle 71 within the upper end of the inner tubular member 58.

An annular chamber 78 is defined between the threaded extension 48 and the inner tubular member 58 and typically receives grease or any other suitable protective medium. A grease plug 80 is threaded into an opening of the primary seal carrier fitting 46 and is removable to permit grease to be introduced into the annular chamber 78.

A J-slot sleeve 82 is positioned in a portion of the annular chamber 78 between the tubular housing 36 and the inner tubular member 58 and defines an internal J-slot geometry which is depicted diagrammatically in FIG. 2A. The J-slot sleeve 82 is undercut externally and defines an elongate recess 83 to minimize its rotational friction with the tubular housing 36 due to the presence of grease between the tubular housing and the J-slot sleeve. Rotational friction of the J-slot sleeve 82 is also minimized by upper and lower bearings 84 and 86, which are interposed between the ends of the J-slot sleeve and components of the tubular housing 36 and serve to permit ease of rotation of the J-slot sleeve and to permit rotatable actuation of the J-slot valve actuating mechanism within the tubular housing 36. The J-slot sleeve 82 defines a J-slot geometry, shown in FIGS. 2, 2A, and 2B, having an elongate substantially straight internal guide track 90 that receives a guide member 92 of a guide boss 94 which is integral with or fixed to the inner tubular member 58 and projects externally thereof. The guide member 92 is also referred to as a "J-pin" since it tracks within the J-slot geometry during relative movement of the tubular housing 36 and the inner tubular member 58. The J-pin guide member 92 provides only a guiding function and accommodates only sufficient force to react with angulated J-slot sections to rotate the J-slot sleeve 82 to its various indexing positions. The guide member is not subjected to tension or compression loads during tool running, pulling or operation. Compression force of the inner tubular member 58 being moved downwardly by the coiled tubing or other tubing, as the case may be, is accommodated by contact of the downwardly facing annular shoulder 66 of the connector fitting 70, while tensile loads, by pulling upwardly on the inner tubular member 58 with the tubing, are accommodated by contact of the upwardly facing guide boss shoulder 95 with the downwardly facing shoulder 98 of the J-slot sleeve 82. This feature permits the inner tubular member 58 to be linearly movable within limits defined by the length of the elongate guide track 90 and by J-slot guide track geometry 96 that is defined within the upper end section of the J-slot sleeve 82. The J-slot geometry 96 of the J-slot sleeve 82 defines upper and lower shoulders 98 and 100 and intermediate angulated slot sections 102 and 104 with angulated slot walls that are engaged by correspondingly angulated guide surfaces 93 of the guide member 92. As these angulated guide slot or track sections are encountered by the guide member 92, the J-slot sleeve is given an increment of rotation which moves the inner tubular member 58 for achieving a desired position. As the inner tubular member 58 is cycled upwardly and downwardly by moving the coiled tubing 14 to which it is connected, the J-slot indexing mechanism controls linear positioning of the inner tubular member 58 and thus actuates the check valve mechanism, to be discussed below, for conventional direct circulating flow or reverse circulating flow by enabling or disabling the check valves.

The lower housing section 40 defines an internal valve chamber 106 within which is received a tubular dual check valve mandrel or housing 108 that is seated on and positioned by a downwardly facing internal annular shoulder 110. The tubular dual check valve housing 108 provides pivotal support for a pair of swing check valve members 112 and 114 that are typically movable to the closed positions thereof responsive to upward or reverse circulating flow of fluid in addition to being spring biased closed by torsion springs surrounding hinge pins 115, thus blocking the upward flow of well fluid through the valve mechanism. The check valves 112, 114 are moved to open positions thereof responsive to downward or direct circulating flow of fluid, thus permitting injection of fluid into the well through the coiled tubing and the check valve mechanism.

For disabling the dual check valves 112, 114 of the check valve mechanism, a tubular lower section 116 is fixed to the inner tubular member 58 by interfitting tubular connector sections 118 and 120 of the inner tubular member 58 and the tubular lower section 116, thus defining a disconnect sleeve assembly. To disable the check valves and permit reverse circulating flow through the check valve mechanism, the inner tubular member 58 is moved to a position locating the lower tubular section 116 within the valve housing 108 as is evident from FIG. 4. When the lower tubular section 116 is removed from within the valve housing the check valve mechanism is restored to its direct circulating flow condition. The tubular connector sections 118 and 120 are releasably secured in assembly by one or more shear pins 122 and are sealed to one another by an optional annular sealing element 124, thus causing the tubular lower section 116 to be linearly movable as a connected component of the inner tubular member 58 as the coiled tubing is cycled upwardly or downwardly within the well. Downward force on the disconnect sleeve connection is accommodated by an annular support shoulder 125 of the tubular valve actuating element, thus preventing the shear pin 122 from being subjected to a compressional shearing force. Thus, shearing of the shear pin or pins 122 of the disconnect sleeve connection can occur only by upward force on the inner tubular member 58 or by application of downward force on the tubular lower section 116. Restoration of the dual check valve mechanism to its direct circulating flow mode from its reverse circulating flow mode simply by moving the inner tubular member 58 upwardly relative to the tubular housing 36 or, under override conditions, releasing the lower end section from the inner tubular member 58 by application of sufficient force to shear the shear pins.

When the dual check valve tool 28 is being pulled from the well or moved upwardly within a tubing string, the pulling force is applied by the coiled tubing to the inner tubular member 58 via the connector fitting 70, thus pulling the inner tubular member 58 to its uppermost position relative to the tubular housing 36 and thus moving the tubular lower section 116 to a position clear of the internal dual check valves, and enabling the check valves 112, 114 for the direct circulating flow mode. Thus the valve mechanism is always in the direct circulating flow mode during pulling of the reversible dual check valve tool from the well. The shear pins 122 provide for release of the tubular valve actuating element 116 from the inner tubular member 58 in the event of override conditions, for the purpose of restoring the check valve mechanism from a disabled or reverse circulation condition to an enabled flow responsive condition if needed. To the lower end of the tubular lower section 116 is mounted a ball seat fitting 126 by a threaded connection 128, with the fitting 126 being sealed to the tubular valve actuating element 116 by O-ring sealing element 130. Within the ball seat fitting 126 is seated a tubular ball seat element 132 having a spherical or tapered internal seating surface segment 134 that is engagable by a ball element, shown in broken line at 136, under override conditions. The tubular ball seat element 132 is sealed with respect to the tubular ball seat fitting 126 by a circular O-ring type sealing element 138. Within the lower housing section 40 of the tubular housing 36 is mounted a tubular connector and spacer element 140 by a threaded connection 142. Concentric spacing of the ball seat fitting 126 and the lower connection end 144 of the lower housing section 40 is maintained by an annular spacer section 146 which is sealed to the lower housing section 40 by an outer O-ring seal 148 and to the ball seat fitting 126 by an inner O-ring seal 150.

In the event the mechanism should become stuck in the reverse circulating flow mode and it becomes necessary to quickly enable the check valve mechanism for direct circulation only, a ball 136 is dropped into the flow passage of the coiled tubing and descends or is pumped to the ball seat 132, thus engaging the seat surface segment 134 and shutting off flow through the flow opening 151 of the ball seat fitting 126. With the ball 136 thus positioned, pressure is applied through the coiled tubing, thus imparting a downward force on the tubular lower section 116 of the inner tubular member 58. When this downward force exceeds the restraining force of the shear pins 122, the shear pins will be sheared and will release the lower tubular section 116 and permit the pressure induced downward force to move the valve actuating element downwardly past the internal annular O-ring seal 150, thus releasing the opening restraint of the check valves 112, 114 and enabling the check valve mechanism to function normally in direct circulating mode only. It should be borne in mind that the reverse circulating valve mechanism of the present invention cannot be run with a conventional check valve assembly above the tool. If a conventional check valve is used above the tool, it will prevent reverse fluid circulation.

A tubular drag spring support mandrel 154 is secured to the tubular connector and spacer element 140 by a threaded connection 156 and with a tubular guide nipple 158 being connected to the lower end of the tubular mandrel 154 by a threaded connection 160. The tubular guide nipple 158 defines a curved or tapered guide nose 162, also known as a "bull nose" which guides the tubular drag spring support mandrel 154 as the dual check valve tool 28 is run into the well. The bull nose 162 defines a fluid flow opening 164 through which fluid interchange to and from the reversible dual check valve tool occurs. The fluid flow opening 164 may comprise multiple small openings to prevent large debris from flowing up the coiled tubing. The bull nose 162 and the tubular drag spring mandrel 154 also define a chamber 155 within which the lower tubular section 116 is received when it is disconnected and displaced clear of the check valve housing as described above. The tubular drag spring support mandrel 154 is provided with upper and lower external stop members 168 and 170 which are chamfered and knurled to increase friction with the drag spring assemblies and prevent rotation of the tubular housing 36 during indexing rotation of the J-slot sleeve 82.

One or more drag spring assemblies, shown generally at 172, are located externally of the tubular drag spring support mandrel 154 and function to apply a restraining force to the tubular housing 36 as downward or upward force is applied via the tubing string or coiled tubing to the inner tubular member 58, and thus cause actuation of the J-slot indexing mechanism with which the reversible dual, selectively actuatable check valve mechanism is provided. The drag spring assembly or assemblies have one or more elongate leaf type spring elements 174 in the general form of a bow, with a central section 176 thereof projecting outwardly for frictional contact with the well tubing 21 or the well casing 20, as the case may be. Respective upper and lower end sections 178, 180 of the spring elements 174 are each connected with upper and lower drag shoe elements 182 and 184 which are each secured to the drag spring by retainer screws 186. The elongate drag springs 174 are designed with low radial spring rate to have acceptable friction with the tubing 20 while running the check valve tool 28 through a tubing string. The drag spring assemblies are linearly movable on the tubular drag spring support mandrel 154 within limits defined by the spacing of the drag shoe elements 182 and 184 and the spacing of the upper and lower stop members 168 and 170 of the tubular drag spring support mandrel 154. Retarding or restraining movement of the housing 36 within the tubing permits linear movement of the inner tubular member 58 relative to the housing 36 and permits incremental rotational movement of the J-slot sleeve 82 responsive to the differential force and consequently permits relative linear positioning of the inner tubular member at valve "Open" and valve "Enabled" positions relative to the tubular housing 36 as controlled by the J-slot indexing mechanism.

The reversible dual check valve tool shown in FIGS. 2–5 is normally in a multi-cycle operating mode, but can be converted to a cycle operating mode simply by removing the J-slot sleeve from the tool or providing an inner tubular member without a J-pin. In its cycle operating mode, the tool is run into the well with its dual check valve mechanism in the reverse circulating flow mode. Restoration of the dual check valve mechanism to its direct circulating mode only is accomplished by application of a tensile or pulling force on the inner tubular member by upward movement of the tubing, thus moving the inner tubular member upwardly relative to the tubular housing and extracting the tubular lower section from within the valve housing.

Though FIGS. 1–5 illustrate a mechanically energized embodiment of the present invention, being the preferred embodiment, it should be borne in mind that the present invention lends itself of valve actuating operation to its "Open" mode and its "Enabled" mode by other means. According to FIGS. 6–8 a through tubing type dual check valve mechanism is shown generally at 190 which is actuated by fluid flow for direct circulation or reverse circulation. The valve mechanism 190 has a housing structure shown generally at 192, basically defined by upper and lower housing sections 194 and 196 and a valve housing section 198. The upper and lower housing sections 194 and 196 are each threadedly connected to an intermediate housing connector 200 and are sealed to the intermediate housing connector 200 by O-ring seals 202 and 204. At its upper end the upper housing section 194 is threaded to a connector fitting 206 and sealed to the fitting by an O-ring seal 208. A tapered or conical surface 209 is defined by the connector fitting 206 to minimize the turbulence of the fluid flowing downwardly or upwardly through the valve mechanism. The valve mechanism is supported within a well and supplied with injection fluid by a tubular member 211, such as a coiled tubing connector which is threaded into the fitting 206 and sealed therewith by means of an O-ring seal 210.

An inner tubular member 212 is located for linear movement within the housing structure 192 and is supported at its upper end by a guide and spacer fitting 214 having a spacer extension 216 that is connected with the upper end of the inner tubular member 212 by a threaded connection 218. The guide fitting 214 is statically sealed to the inner tubular member 212 by an O-ring seal 220 and is dynamically sealed with the inner cylindrical wall surface 222 of the upper housing section 194 by an O-ring seal 224. The fitting 214 also defines a tapered or conical guide surface 226 that serves to permit smooth flow of injected fluid into the inner passage 228 of the inner tubular member 212. The spacer extension 216 defines an annular spring support shoulder 230 which is engaged by the upper end of a compression spring 232 that is located within the annular space 234 or spring chamber that is defined between the upper housing section 194 and the inner tubular member 212. The lower end of the compression spring is seated on an annular spring support shoulder 236 that is defined by the upper end of the intermediate housing connector 200. Though a mechanical compression spring acts to return the inner tubular member and tubular housing to the condition permitting only direct circulation through the check valve mechanism, it should be borne in mind that the spring force may be applied by a compressed gas spring or any other such force transmitting element without departing from the spirit and scope of the present invention.

The concentric spacing of the inner tubular member 212 from the upper and lower housing sections that is achieved by the guide and spacer fitting 214 also defines an annular indexing chamber 238 within which is disposed a J-slot sleeve element 240 having upper and lower end portions 242 and 244 that are mounted for rotation within the indexing chamber 238 by upper and lower bearings 246 and 248. The J-slot sleeve element 240 defines internal grooves or slots that establish a J-slot geometry as shown by the J-slot layout view of FIG. 7A. The inner tubular member 212 is provided with a guide boss 250 that may be integral with the inner tubular member 212 or welded or otherwise fixed to project externally from the inner tubular member. The guide boss 250 defines a guide pin 251, also known as a J-pin, which is adapted to sequentially traverse the J-slot geometry of FIG. 7A and achieve indexing of the inner tubular member to predetermined positions within the housing structure 192.

The valve housing section 198 is connected to the lower end of the lower housing section 196 by a threaded connection 252 and is sealed to the lower housing section by an O-ring seal 254. An annular valve chamber 256 is defined by the valve housing section 198 and receives a dual check valve assembly 258 having upper and lower check valves 260 and 262 that are shown to be in the form of pivotally mounted flapper type check valves that are shown in FIG. 8 to be restrained in the inoperative positions thereof so as to permit both direct and reverse circulating flow of fluid through the valve mechanism. The upper end of the valve assembly is seated on an annular internal shoulder 264 of the valve housing section 198 while the lower end of the valve assembly is secured in position by an annular shoulder 266 that is defined by a threaded extension 268 of a tubular flow nipple 270 which is connected within the lower end of the valve housing section 198 and sealed therewith by an O-ring seal 272. The tubular flow nipple is of sufficient length to define a receptacle 274 that is adapted to receive the lower end section 276 of the inner tubular member 212 in the event it should become disconnected from the inner tubular member. The lower end section 276 is provided at its upper end with a connection sleeve 278 that is slip fitted within a lower connection sleeve 280 of the inner tubular member 212 and is sealed therewith by an O-ring seal 282. One or more shear pins 284 extend through aligned apertures of the connection sleeves 278 and 280 and when sheared, will release the connection of the inner tubular member 212 and the lower end section 276. The shear pins 284 can be sheared by downward force on the lower end section 276. A downward disconnect procedure would be accomplished in the event the well condition requires immediate restoration of the dual valve mechanism from the reverse circulation mode to the direct circulation mode.

An actuator housing 286 is secured to the lower end of the lower end section 276 by a threaded connection 288 and is sealed to the lower end section 276 by an O-ring seal 290. Within the actuator housing 286 is seated an annular override closure seat 292 having an annular tapered seat surface 294 for engagement by an override closure ball 296 that is shown in broken line. In the event override restoration of the direct flow mode of the valve mechanism is needed, an override closure ball is dropped into the tubing or coiled tubing string and injection pressure is applied. When the ball 296 becomes seated on the annular override closure seat 292, additional injection pressure will be applied to develop a downward force on the lower end section 276 to shear the shear pins 284, thus releasing lower end section 276 from the inner tubular member 212. The injection pressure will force lower end section 276 downwardly past the dual check valves 260 and 262 and into the receptacle 274, thus allowing the check valves to be closed by upward flow of fluid.

It is desirable to provide flow responsive upwardly and downwardly cycling actuation of the inner tubular member 212 and its lower end section 276. To accomplish this feature, an orifice fitting 298 is connected to the lower end of the actuator housing 286 by a threaded connection 300. The orifice fitting 298 defines an inner tapered seat surface 302 that is disposed for engagement by an actuator ball 304 that is maintained within an actuator chamber 306 by one or more internal ball retention elements 308. The internal ball retention elements 308 retain the actuator ball 304 within the actuator chamber 306 when upward flow is occurring, but do not establish sealing with the ball, thus permitting upward flow of fluid past the actuator ball, as shown by the flow arrows, when the actuator ball 304 is forced upwardly by fluid flow and is in retained engagement with the ball retention elements 308. The orifice fitting 298 also defines one or more orifice controlled flow passages 310, with changeable orifice inserts 312 threaded or otherwise secured therein. The orifice inserts 312 each define a flow passage orifice of a desired dimension to permit downward flow of fluid past the seated actuator ball and into the receptacle 274. This downward flow fluid will then flow through injection ports 314 in the closed lower end 315 of the tubular flow nipple 270.

Operation of Embodiment of FIGS. 6–8

Responsive to downward flow of fluid through the coiled tubing and through the orifice controlled flow passage or passages 310, pressure differential will develop across the orifice inserts 312, and this pressure differential, acting on the piston area that is defined by the piston O-ring seal 224, less the orifice area 312 will develop a downwardly acting force on the inner tubular member 212, acting against the preload force of the compression spring 232. When this preload force is exceeded, the compression spring 232 will deflect and will allow downward movement of the inner tubular member 212 relative to the tubular housing 192. This flow responsive downward movement of the inner tubular member 212 causes the lower tubular section 276 of the inner tubular member 212 to move within the check valve assembly 258 as shown in FIG. 8, thus disabling the dual check valves 260 and 262 and securing the check valves in their open positions, thus defining a reverse circulating flow path through the reversible dual check valve mechanism to permit reverse circulating flow. To restore the dual check valve mechanism to its direct circulating flow mode, fluid pressure is simply diminished. When the flow responsive force on the inner tubular member 212 has decreased below the preload force of the compression spring 232, the spring force will move the inner tubular member 212 upwardly relative to the tubular housing 192 and will withdraw the tubular lower section 276 from the valve housing, thereby enabling the check valves for reverse flow responsive closure. In this mode, the dual check valve mechanism will function in the conventional sense, with the check valves enabled for the direct circulating flow mode only.

Typically, the dual check valve mechanism or tool will be run into the well with the check valves in their "Enabled" position, so that the check valve mechanism is enabled for its direct circulating mode. As shown in the J-slot layout illustration of FIG. 7A, the J-pin 251 will be located at an upper position within the elongate, substantially straight and vertically oriented section 253. As the flow responsive downward force is developed and the preload force of the compression spring is overcome, the J-pin 251 will move downwardly within the guide track or slot 253 until it comes into contact with the inclined slot edge surface 255 where its further downward movement causes rotation of the J-slot sleeve element 240 and permits the J-pin to track to the lowermost, "Indexing" position. At this point pressure injection through the coiled tubing is stopped and the pressure is allowed to bleed off through the flow passage of the orifice insert 312. This causes dissipation of the differential pressure induced force acting on the inner tubular member and permits the compression spring 232 to move the inner tubular member 212 upwardly relative to the tubular housing 192. During this upward movement of the inner tubular member, the J-pin will move upwardly from the indexing position and will contact the inclined slot edge surface 257 where it causes further indexing rotation of the J-slot sleeve and then moves to the "Open" position of the J-slot geometry. Thus, the J-slot indexing mechanism can be selectively cycled to actuate the check valve mechanism for direct circulating flow or reverse circulating flow simply by controlling the fluid flow through the tool 190 to accomplish linear movement of the inner tubular member 212 relative to the tubular housing 192.

Referring now to FIGS. 9–13, another embodiment of the flow actuated reversing valve of the present invention is shown generally at 316 and has significant similarities with the alternative embodiment of FIGS. 6–8. Thus, like reference numerals are utilized to indicate like parts. The threaded extension 268 of the tubular flow nipple 318 establishes a threaded connection 320 within the lower internally threaded end of the valve housing section 198. The threaded connection 320 is sealed by O-ring seal 322. To prevent relative rotation of the valve housing section 198 and the tubular flow nipple 318, and to maintain specific alignment of the tubular flow nipple and the valve housing section, one or more rotational alignment locking screws 324 are engaged within a groove in the valve housing section 198 and the externally threaded extension 268 of the tubular flow nipple 318. Internally of the tubular flow nipple 318 and intermediate its length there is defined an internal boss or flange 326, which is shown in greater detail in FIGS. 12 and 13. The internal boss or flange 326 defines upper and lower tapered shoulder surfaces 328 and 330 each intersecting a flow control surface 332. An actuator housing 334 establishes threaded connection at 288 with the externally threaded lower section 276 of the inner tubular member 212 and defines an external cylindrical surface 336 that is adapted for positioning in close proximity with the internal flow control surface 332 so as to define a close clearance 338 therewith. This close clearance 338 permits fluid to flow between the internal boss 326 and the actuator housing 334, but at a restricted flow rate when the components are positioned as shown in FIGS. 11 and 12. When the actuator housing 334 is positioned with the orifice 346 located above the upper tapered shoulder 328 or below the lower tapered shoulder 330, or in a rotational alignment where orifice 346 is not aligned with internal boss 326, a lower differential pressure due to fluid flow through the orifice 346 will be apparent at the surface. Also, the flow responsive downward force on the inner tubular member 212 will be greater when the orifice is restricted as shown in FIGS. 11 and 12. The actuator housing 334 defines an internal thickened wall structure or internal boss 340 having a threaded opening 342 within which is received an orifice insert 344 having an orifice for controlling the flow of fluid therethrough. At the lower end of the actuator housing 334 a ball seat fitting 348 is received by a threaded connection 350 and is sealed therewith by an O-ring seal 352. The ball seat fitting 348 cooperates with the actuator housing wall to define a valve chamber 353. The ball seat fitting 348 defines a tapered ball seat 354 that is located about a flow passage 355 and is engaged by a flow control ball 356 that is movable within the valve chamber 353 and functions as a check valve responsive to fluid flow to close the flow passage 355 upon downward flow and to be moved away from the seat 354 by upward or reverse flow. A transverse ball restraint element 358 extends across the valve chamber 353 and serves to restrict upward flow responsive movement of the valve ball 356 while permitting upward fluid flow past the valve ball 356 and through the flow passage 355 and valve chamber 353.

Operation of Embodiment of FIGS. 9–13

This dual check valve and reversing valve tool embodiment utilizes fluid flow down the coiled tubing to actuate the J-slot indexing mechanism to the selective modes of the tool. The flow down the coiled tubing acts across an orifice to generate a pressure differential that acts on the effective piston area at 224 to generate a downward force. Once this (pressure times area) force exceeds the downward force of the compression spring plus seal and J-slot friction, the piston will move down. This will happen at a given repeatable flow rate (thus the name of the tool). In order to make the piston move down against the spring, a small orifice 346 (changeable orifice insert 344) is required, typically 0.375 inch (9.5 mm) diameter. When reversing sand up the coiled tubing, the pressure drop due to this orifice is undesirable. Thus the orifice is bypassed during reverse flow by a check valve. The check valve may be a ball, poppet or flapper type. A ball type check valve (actuating ball and seat) is shown due to its positive sealing and streamlining under reverse flow. The ball and seat can easily be made of tungsten carbide thus preventing erosion problems. The downstream pressure is channeled up the annulus of the tool between the housing and the mandrel to immediately below the piston area 224. This is why the orifice pressure differential acts on the effective piston area. If the orifice is axial, the effective piston area is the piston outer diameter area minus the orifice area. If the orifice is transverse, the effective area is the entire piston area.

It is desirable to provide a means for ensuring that the tool is in the reversing position by simply pumping down the coiled tubing using the bottom check valve at the lower end of the mandrel and using a lateral port which also serves as the orifice in the sleeve above the bottom check valve. The lateral port has a small gap or clearance for flow only in the pre-reversing position. This necessitates a sleeve that can be positioned rotationally to align in the proper manner over the ball seat sleeve at the bottom of the piston mandrel. The gap or clearance can be adjusted to accommodate varying flow rate settings.

The flow rate required for the orifice pressure differential to overcome the spring force with flow down the coiled tubing can be easily adjusted by changing the orifice and/or the spring. Typically this flow rate would be 0.5 to 3 barrels per minute (80 to 477 liters per minute). The example below uses 2 barrels per minute (318 liters per minute) as a flow rate where the orifice pressure has caused the mandrel to fully stroke to the down position (pre-reversing or pre-conventional).

In the absence of flow responsive pressure differential across the orifice 346, the preload force of the compression spring 232 will position the inner tubular member 212 at its uppermost position within the housing 192, thus positioning the lower end section 276 and its actuator housing above the dual check valves and enabling the valve mechanism for direct circulation flow only. Upward, i.e., reverse flow of fluid through the valve mechanism will be prevented by closure of the dual check valves 260 and 262. To position the valve mechanism for both direct circulation and reverse circulation, injection pressure through the coiled tubing and valve mechanism is initiated, causing the flow control ball 356 to seat on the annular seat surface 354 of the ball seat fitting and preventing downward flow of fluid through the flow passage 355. Thus, downward flow of fluid from the coiled tubing will occur only through the orifice 346 of the orifice insert 344, thereby developing a pressure differential across the orifice and a resultant pressure differential induced downward force on the inner tubular member 212 that will act on the compression spring 232. When the preload force of the compression spring has been overcome, the pressure differential induced downward force will move the inner tubular member downwardly, causing the J-pin 251 to track downwardly within an elongate substantially straight guide track 253, shown in FIG. 10A. During this downward movement of the inner tubular member 212, the tapered nose 349 of the ball seat fitting 348 will move the dual check valves to their open positions as shown in FIG. 11. When the check valves are restrained at their open positions as shown, the valve mechanism will be positioned for both direct and reverse circulation. As the J-pin 251 is moved downwardly, as its lowermost position is approached, it will contact the inclined slot surface 255 causing 90° rotation of the J-slot sleeve, and will continue downward movement until it reaches the pre-reversing position 257. The well operator will confirm this position by a pressure increase (if flow rate is held constant) due to positioning of the orifice 346 within the annular boss 326, so that flow occurs only through the close annular clearance 338. To permit reverse flow, the downward flow of fluid being pumped is ceased and the coiled tubing is vented at the surface. Simultaneously, the downward force across the orifice is dissipated, causing the compression spring to move the inner tubular member 212 upwardly so that the J-pin 251 moves upwardly within the J-slot geometry and contacts the inclined slot edge surface 265 and develops a rotational force on the J-slot sleeve, causing its rotation another 90° increment and permitting the J-pin 251 to move to the reversing position shown at 259 in FIG. 10A. At this position the orifice 346 will be positioned above the internal boss 326. To again enable the valve mechanism for direct circulation only, fluid flow is increased causing the differential pressure induced force on the inner tubular member 212 to move the inner tubular member downwardly and causing the J-pin 251 to traverse the J-slot geometry from the position 259 to the position 261. During this downward movement of the inner tubular member against the compression force of spring 232 the J-pin will contact the inclined slot surface 263 of the J-slot geometry causing the J-slot sleeve to rotate another 90° increment. At this position while flowing down the coiled tubing, a reduced pressure will be measured at the surface since the orifice 346 will not be rotationally aligned with the boss 326. From position 261 diminished or terminated flow will reduce the downward force on the compression spring and will thus allow the compression spring to move the inner tubular member 212 upwardly. When this occurs, the J-pin 251 will contact the inclined slot surface 269 and will rotate the J-slot sleeve another 90° increment and allow the J-pin 251 to traverse the straight slot section 271 and move to position 267, at which position the lower portion of the inner tubular member and its lower end section 276 will be clear of the dual check valves, allowing them to close responsive to upward fluid flow and prevent reverse circulation.

In the event of override conditions requiring immediate restoration of the valve mechanism to direct circulation only, injection pressure may simply be increased sufficiently to develop differential pressure across the orifice so that a downward resultant force on the inner tubular member 212 is sufficiently great that the disconnect shear pins 284 will be sheared. When the lower end section 276 and the actuator housing 334 are disconnected from the inner tubular member 212, downward fluid flow will move these components downwardly past the dual check valves and into the receptacle 274. As injection flow is diminished, the well fluid, flowing upwardly, will move the check valves to their closed positions, isolating the tubing string from well pressure. Alternatively, a ball 296 may be dropped or pumped through the coiled tubing to obstruct the annular seat 294 causing pressure to shear the shear pins 284.

Referring now to FIGS. 14–16, an alternative embodiment of the present invention is shown generally at 360 that is actuated between its direct circulating mode and reverse circulating mode by mechanical compression. This dual check valve selective direct and reverse circulating valve tool requires tagging fill (typically sand) within the well to actuate a J-slot indexing mechanism to selectively actuate the tool for either its direct circulating mode or its reverse circulating mode. It should be borne in mind that in its reverse circulating mode the dual check valves of the tool will be maintained open, thereby permitting both direct circulation and reverse circulation flow through the valve mechanism. A spring between the coiled tubing and the bullnose transfers all axial force and provides the stroke need to actuate the J-slot mechanism of the tool. The spring also keeps the tool in position with the check valves active unless fill within the well is tagged. The spring would be typically preloaded to about 500 pounds (227 kg). This preload force is chosen so that the coiled tubing is easily able to generate the required set-down load to actuate the J-slot mechanism when the coiled tubing is helically buckled within the casing. The load must also be sufficient so that the spring return force can overcome seal and debris friction. Only a tag (set down) in excess of 500 pounds (227 kg) would actuate the J-slot mechanism.

The dual check valve selective direct and reverse circulating valve tool 360 has a housing assembly, shown generally at 362 being defined by an upper housing section 364 that is secured by a threaded connection 366 to a valve housing section 368. The upper housing section 364 is sealed to the valve housing section 368 by an O-ring seal 370. A tubular flow nipple 372, also referred to as a bullnose, is secured to the lower end of the valve housing section 368 by a threaded connection 374 and is sealed therewith by an O-ring seal 376. The tubular flow nipple 372 defines an internal chamber 373 and is provided at its lower closed and rounded end 378 with flow passages 380 through which fluid is injected into the well and through which reverse flow from the well is permitted to occur when the dual check valve mechanism is selectively actuated to permit reverse fluid circulation. The internal chamber 373 is of sufficient length to receive the lower tubular end of the inner tubular member when an override procedure occurs as discussed below.

An inner tubular member 382 is linearly movable within the housing assembly, with its upper end 384 having threaded connection at 386 within a connection collar fitting 388. Tubing 390, such as coiled tubing, is also received within and establishes a threaded connection at 392 with the connection collar fitting 388. O-ring seals 394 and 396 accomplish sealing of the tubing and the inner tubular member with respect to the connection collar fitting. To prevent relative rotation of the connection collar fitting 388 and the inner tubular member 382 when the tool is within the tubing of the wellbore, an anti-rotation screw 398 is threaded through the connection collar fitting and engages a groove in the upper end 384 of the inner tubular member. The inner tubular member 382 is provided intermediate its extremity with an externally projecting boss 383 which may be integral with the inner tubular member or may be welded or otherwise fixed to the inner tubular member. From the externally projecting boss 383 projects a J-pin element 385.

The connection collar fitting 388 defines an annular force transmitting shoulder 400 that is engaged by the upper end of a compression spring 402 that is located externally of the inner tubular member 382. The lower end of the compression spring 402 is seated on an annular shoulder 404 of a housing closure fitting 406 that is connected into the upper internally threaded end of the upper housing section 364 at a threaded connection 408. An O-ring seal 410 establishes sealing of the housing closure fitting 406 with the upper housing section 364 and an O-ring seal 412 establishes dynamic sealing of the housing closure fitting 406 with the external cylindrical surface 414 of the inner tubular member 382. The threaded projection 416 of the housing closure fitting 406 also serves as a spacer to establish a spaced relation between the housing assembly 362 and the inner tubular member 382, thus defining an annular chamber 418 within which is located an elongate tubular J-slot sleeve 420. Upper and lower bearings 422 and 424 provide rotatable support for the elongate tubular J-slot sleeve 420 within the chamber 418 and thus provide for its rotation within the chamber 418 for indexing of the valve mechanism to its direct circulation mode and to its reverse circulation mode. The threaded projection 416 defines a downwardly facing shoulder 426 that engages and positions the upper bearing 422 while the lower bearing 424 is seated on a support shoulder 428 that is defined within the lower portion of the upper housing section 364.

The internal surface of the generally cylindrical J-slot sleeve defines an indexing slot geometry which is shown in detail by the J-slot layout illustration of FIG. 15A. In FIG. 15, the inner tubular member 382 is shown at its "Valves Open" and "Indexing" position relative to the tubular housing assembly 362, with the check valves being maintained open by the tubular lower section of the inner tubular member.

An externally threaded projection 365 on upper housing section 364 serves a spacing function to position the inner tubular member 382 in spaced relation with the upper housing section 364 and the valve housing section 368 and defines a valve chamber 430. A dual check valve assembly 432 is located within the valve chamber 430 and is provided with a pair of check valve elements 434 and 436 that are preferably of the swing or flapper type, but may be ball, poppet or any other type of suitable check valves within the spirit and scope of the present invention.

A tubular lower end section 438 of the inner tubular member 382 is connected to the inner tubular member by a disconnect connection that is defined by engaging connection sleeves 440 and 442 of the inner tubular member 382 and the tubular lower end section 438 which are secured in releasable assembly by one or more shear pins 444 and are maintained in sealed assembly by an O-ring seal 446. The tubular lower end section 438 functions as a valve actuator to open and maintain the check valves 434 and 436 open in order to permit reverse circulation flow and direct circulation flow to occur. The valve open, or reverse circulation condition of the tool is shown in FIGS. 14–16 and is particularly evident in FIG. 16. To selectively actuate the tool for direct circulation only, it is necessary that the check valves 434 and 436 be free to move to the closed positions thereof responsive to upward or reverse flow conditions. This is accomplished by moving the inner tubular member 382 and its tubular lower end section 438 upwardly to a position where the lower end of the tubular lower end section 438 is clear of the uppermost check valve 434. This upward movement of the inner tubular member 382 is accomplished by the force of the compression spring 402 and is controlled by the J-slot valve actuating section of the tool which is shown in FIG. 15A and is described in greater detail below.

A tubular valve seat retainer fitting 448, which defines the lower end of the tubular lower end section 438 is threaded to the tubular lower end section at 450 and sealed by an O-ring seal 452. The tubular valve seat retainer fitting 448 defines an upwardly facing seat shoulder 454 on which a tubular ball seat 456 is seated. The tubular ball seat 456 defines a circular ball seat surface 458 against which an override ball, shown in broken line at 460, becomes seated in the event an override procedure should become necessary. The override ball is dropped through the well tubing and comes to rest on the seat surface 458 when an override procedure is needed. With the override ball 460 so seated, pressure is applied to the tubing from the surface, thereby developing a downward pressure responsive force on the override ball and seat and causing shearing of the shear pin or pins 444 and accomplishing a disconnect of connection sleeves 440 and 442 and allowing the pressure induced force on the override ball and the tubular lower end section 438 to move the tubular lower end section downward into the chamber 373 of the tubular flow nipple 372 and clear of the check valves, thus enabling the check valves for direct circulation only.

Operation of Embodiment of FIGS. 14–16

Operation of the tool mechanism of FIGS. 14–16 is explained as follows, in connection with the J-slot valve actuating geometry of FIG. 15A. The elongate tubular J-slot sleeve 420 defines an internal slot geometry as shown by the J-slot groove layout of FIG. 15A. During running of the tool into the tubing within the wellbore or "hole", the tool is typically in its "Enabled" position, with the force of the compression spring 402 maintaining the inner tubular member 382 and its lower tubular extension 438 positioned above the check valves 434 and 436 and thus permitting flow responsive closing of the check valves by upward flow of fluid from the well and maintaining the check valves closed by pressure differential acting across the check valves. At this position, the J-pin 385 is at its uppermost position with respect to the J-slot geometry. It should be borne in mind that the tool can be run into the hole in its "Open" condition, with the check valves secured open if desired, to permit both direct and reverse circulation during running of the tool.

The tool is moved downwardly within the well until the lower rounded bullnose 378 at the lower end of the tubular flow nipple 372 comes into contact, i.e., tags the fill, typically sand, within the well casing, at which point downward movement of the housing assembly 362 will stop. As further downward mechanical force is applied via the tubing string to the connection collar fitting 388 and the inner tubular member 382, the preload force of the compression spring 402, i.e., about 500 pounds (227 kg), will be overcome and the inner tubular member 382 will begin to move downwardly relative to the housing assembly 362. Referring to FIG. 15A, the J-pin 385 will begin to move downwardly within the elongate straight slot section 421, being guided by the sidewalls 423. After sufficient downward movement of the J-pin has occurred that it comes into contact with an inclined slot section 425 and contacts slot sidewall 427 a rotational force is applied to the J-slot sleeve 420 causing its rotation until such time as the J-pin becomes aligned with the slot section 429, whereupon the J-pin will move downward to its "Indexing" position. During this downward movement of the J-pin the inner tubular member 382 and its lower tubular section 438 will move downwardly in like manner, causing the lower tubular section 438 to move into the check valve assembly 432 and to force the check valves 434 and 436 to their open positions. This condition can be detected at the surface if pressure is being applied to the annulus during running of the tool.

From the "Indexing" position of the J-pin, reduction of the downward force acting on the inner tubular member 382 will permit the compression spring 402 to move the inner tubular member 382 upwardly relative to the housing assembly 362, causing the J-pin 385 to move upwardly within the slot section 429. During such upward J-pin movement it will contact the inclined sidewall 431 of inclined slot section 433, with its upwardly directed force causing further rotation of the J-slot sleeve 420 until the slot section 435 is encountered. Upward movement of the J-pin 385 and thereby the inner tubular member 382 occurs responsive to the force of the compression spring 402, the upward movement of the J-pin will proceed to the "Open" position. At this "Open" position of the J-pin, the check valves will be retained open and both direct and reverse circulation through the valve mechanism will be permitted.

Sequencing of the indexing mechanism and thus the valve mechanism back to its "Enabled" position will occur by simply again applying downward force on the inner tubular member from the "Open" position to cause rotation of the J-slot sleeve another rotational increment to permit the J-pin to encounter another elongate, substantially vertically oriented slot section such as that shown at 421 in FIG. 15A.

In view of the foregoing it is evident that the present invention is one well adapted to attain all of the objects and features hereinabove set forth, together with other objects and features which are inherent in the apparatus disclosed herein.

As will be readily apparent to those skilled in the art, the present invention may easily be produced in other specific forms without departing from its spirit or essential characteristics. The present embodiments are, therefore, to be considered as merely illustrative and not restrictive, the scope of the invention being indicated by the claims rather than the foregoing description, and all changes which come within the meaning and range of equivalence of the claims are therefore intended to be embraced therein.

We claim:

1. A method for tubing check valve operation, comprising:

running a check valve assembly having at least one check valve into a well to a desired depth with a tubing string connected thereto, said check valve assembly having a tubular housing and an inner tubular member having at least a portion thereof movable within said tubular housing wherein said tubular housing defines a lower end for tagging contact with material located within the well and a spring is disposed in spring force application with said tubular housing and said inner tubular member for normally urging said inner tubular member to said first position relative to said tubular housing; wherein said method further comprises running said check valve assembly into the well until tagging contact with said material is established;

applying a downward force on said inner tubular member with said tubing string and overcoming said spring force and moving said inner tubular member downwardly from said first position to an indexing position relative to said tubular housing; and reducing said downward force on said inner tubular member and allowing said spring force to move said inner tubular member from said indexing position to said second position relative to said tubular housing;

wherein a J-slot is configured on one of said tubular housing and said inner tubular member and defines an indexing slot geometry and a J-pin projects from the other of said tubular housing and said inner tubular member and is received in guided relation within said J-slot geometry, said J-slot geometry establishing said first and second positions and an indexing position between said first and second positions, said method further comprising initiating actuation of said at least one check valve with said tubular housing and said inner tubular member at a selected one of said first and second positions as determined by said J-slot geometry;

relatively linearly moving said tubular housing and said inner tubular member from said selected position to said indexing position as determined by said J-slot geometry and positioning of said J-slot and said J-pin; and relatively linearly moving said tubular housing and said inner tubular member from said indexing position to another selected one of said first and second positions as determined by said J-slot geometry and positioning of said J-slot and said J-pin;

selectively establishing a first condition for said check valve assembly permitting direct circulation flow therethrough and preventing reverse circulation flow of fluid from the well through said check valve assembly;

selectively establishing a second condition for said check valve assembly with said at least one check valve positioned for permitting both direct circulation flow and reverse circulation flow therethrough, wherein said selectively establishing said first and second conditions comprises moving said inner tubular member to a first position within said tubular housing permitting opening and closing of said at least one check valve and moving said inner tubular member to a second position maintaining said at least one check valve open; and selectively restoring said check valve assembly to said first condition.

2. The method of claim 1 wherein a drag spring assembly is mounted externally of said tubular housing and is disposed for frictional resistance with well tubing within which said check valve assembly is located, said method further comprising:

linearly moving said inner tubular member downwardly and resisting downward movement of said tubular housing with said drag spring assembly and positioning said inner tubular member within said tubular housing at a position preventing closure of said at least one check valve, thus actuating said at least one check valve for both direct circulation flow and reverse circulation flow; and linearly moving said inner tubular member upwardly while restraining upward movement of said tubular housing with said drag spring assembly for positioning said inner tubular member at a position within said tubular housing permitting closure of said at least one check valve, thus permitting only direct circulation flow though said at least one check valve.

3. A method for tubing check valve operation, comprising:

running a check valve assembly having at least one check valve into a well to a desired depth with a tubing string connected thereto, said check valve assembly having a tubular housing and an inner tubular member having at least a portion thereof movable within said tubular housing;

selectively establishing a first condition for said check valve assembly permitting direct circulation flow therethrough and preventing reverse circulation flow of fluid from the well through said check valve assembly;

selectively establishing a second condition for said check valve assembly with said at least one check valve positioned for permitting both direct circulation flow and reverse circulation flow therethrough, wherein said selectively establishing said first and second conditions comprises moving said inner tubular member to a first position within said tubular housing permitting opening and closing of said at least one check valve and moving said inner tubular member to a second position maintaining said at least one check valve open; and selectively restoring said check valve assembly to said first condition, wherein a J-slot indexing mechanism controls relative positioning of said tubular housing said inner tubular member and a compression spring is in force applying assembly with said tubular housing and said inner tubular member and sand fill is present within the well to a desired depth, said method further comprising:

moving said check valve assembly downwardly within the well until the sand fill is contacted by said tubular housing;

applying a downward force on said inner tubular member for continuing downward movement of said inner tubular member relative to said tubular housing causing compression of said compression spring and causing valve actuating cycling of said J-slot indexing mechanism; and relaxing the downward force on said inner tubular member, permitting said compression spring to move said inner tubular member upwardly relative to said tubular housing causing valve actuating cycling of said J-slot indexing mechanism.

4. A method for tubing check valve operation, comprising:

running a check valve assembly having at least one check valve into a well to a desired depth with a tubing string connected thereto, said check valve assembly having a tubular housing and an inner tubular member having at least a portion thereof movable within said tubular housing;

selectively establishing a first condition for said check valve assembly permitting direct circulation flow therethrough and preventing reverse circulation flow of fluid from the well through said check valve assembly;

selectively establishing a second condition for said check valve assembly with said at least one check valve positioned for permitting both direct circulation flow and reverse circulation flow therethrough wherein said selectively establishing said first and second conditions comprises moving said inner tubular member to a first position within said tubular housing permitting opening and closing of said at least one check valve and moving said inner tubular member to a second position maintaining said at least one check valve open; and selectively restoring said check valve assembly to said first condition, wherein a flow orifice is located within said inner tubular member and defines a pressure responsive piston area, a tubular valve housing within said tubular housing supports said at least one check valve for opening and closing movement, a compression spring is in force transmitting relation with said tubular housing and said inner tubular member and relative movement of said tubular housing and said inner tubular member is responsive to flow induced force developed by pressure differential across said flow orifice and a J-slot indexing mechanism controls relative valve mode positioning of said tubular housing and said inner tubular member responsive to linear cycling movement of said tubular housing and said inner tubular member, said method further comprising:

with said check valve assembly positioned at a selected depth within the well, causing fluid flow through said tubing to said check valve assembly and through said flow orifice, causing development of a pressure differential across said orifice acting on said pressure responsive piston area and developing a downward resultant force on said inner tubular member in opposition to said force of said compression spring and moving said inner tubular member downwardly relative to said tubular housing and moving a portion of said inner tubular member into said tubular valve housing for retaining said at least one check valve open for defining a reverse circulating flow path through said check valve mechanism; and for restoring said check valve mechanism for direct circulation flow only, reducing said fluid flow through said orifice for diminishing said flow responsive resultant force on said inner tubular member and permitting spring force movement of said inner tubular member relative to said tubular housing sufficiently to withdraw said portion of said inner tubular member from said tubular valve housing and thus enable said at least one check valve for direct circulating flow only.

5. A tubing connected check valve mechanism for wells, selectively actuatable for direct circulation flow and reverse circulation flow, comprising:

a tubular housing having at least one check valve therein having a first valve position permitting only direct circulating flow therethrough and a second valve position permitting reverse circulating flow of fluid therethrough;

an inner tubular member linearly movable relative to said tubular housing and having a first position within said tubular housing permitting opening and closing of said at least one check valve and a second position within said tubular housing maintaining said at least one check valve open and permitting reverse flow circulation through said at least one check valve;

an actuating system for imparting upward and downward cycling movement of said inner tubular member relative to said tubular housing; and a position indexing mechanism located within said tubular housing and selectively actuatable to select check valve controlling positions of said inner tubular member relative to said tubular housing, wherein said actuating system comprises tubing connected to said inner tubular member and extending to the surface of a well, said tubing being moved linearly upwardly or downwardly for upward or downward movement of said inner tubular member;

a drag support mandrel defined by said tubular housing; and at least one frictional member movably supported by said drag support mandrel and having a first portion thereof in movable engagement with said drag support mandrel and a second portion thereof in frictional engagement with a well tubular or borehole wall retarding linear movement of said tubular housing as said inner tubular member is moved.

6. The tubing connected check valve mechanism of claim 5, wherein said at least one frictional member comprises:

an elongate leaf-type drag spring having an outwardly extending intermediate section for frictional engagement with said well tubular or said borehole wall and defining upper and lower ends; and upper and lower drag shoes fixed respectively to said upper and lower ends of said elongate leaf-type drag spring and having movable engagement with said drag support mandrel.

7. The tubing connected check valve mechanism of claim 6, further comprising:

upper and lower stop members projecting from said drag support mandrel and disposed in spaced relation;

said drag shoes respectively contacting said upper and lower stop members to limit upward and downward linear movement of said frictional member relative to said drag support mandrel.

8. The tubing connected check valve mechanism of claim 7, wherein:

said upper and lower stop members are chamfered and knurled to increase friction between said drag shoes and said stop members and prevent said tubular housing from rotating during operation of said position indexing mechanism.

9. A tubing connected check valve mechanism for wells, selectively actuatable for direct circulation flow and reverse circulation flow, comprising:

a tubular housing having at least one check valve therein having a first valve position permitting only direct circulating flow therethrough and a second valve position permitting reverse circulating flow of fluid therethrough;

an inner tubular member linearly movable relative to said tubular housing and having a first position within said tubular housing permitting opening and closing of said at least one check valve and a second position within said tubular housing maintaining said at least one check valve open and permitting reverse flow circulation through said at least one check valve;

an actuating system for imparting upward and downward cycling movement of said inner tubular member relative to said tubular housing; and a position indexing mechanism located within said tubular housing and selectively actuatable to select check valve controlling positions of said inner tubular member relative to said tubular housing wherein said actuating system comprises a spring acting on said tubular housing and said inner tubular member and normally positioning said inner tubular member at said first position relative to said tubular housing;

a piston area defined within said inner tubular member;

an orifice located within said inner tubular member; and wherein fluid flow from said tubing acting across said orifice develops a pressure differential acting on said piston area and creates a flow responsive actuating force opposing said spring, when said flow responsive actuating force exceeds said spring force said actuating force moves said inner tubular member from said first position to said second position, when said flow responsive actuating force is less than said spring force said spring force returns said inner tubular member and said tubular housing to said first position.

10. The tubing connected check valve mechanism of claim 9, further comprising:

a ball seat defined within said inner tubular member;

said orifice being defined within said ball seat; and an actuator ball located within said inner tubular member and seated on said ball seat responsive to direct circulating flow to permit flow only through said orifice and being movable from said ball seat responsive to reverse circulating flow.

11. The tubing connected check valve mechanism of claim 9, further comprising:

a valve housing located within said tubular housing and having said at least one check valve mounted therein;

said inner tubular member having an upper tubular section and a lower tubular section having releasable connection, said lower tubular section being located within said valve housing at said second position of said inner tubular member relative to said tubular housing and preventing reverse circulating flow responsive closure of said least one check valve;

an override seat defined within said lower tubular section located above said at least one check valve;

an override ball dropped through said tubing and becoming seated on said override seat; and wherein said releasable connection is released by downward force on said lower tubular section generated by fluid pressure from said tubing acting on said override ball and override seat and said lower tubular section is moved downwardly from said valve housing permitting reverse circulating closure of said at least one check valve.

12. The tubing connected check valve mechanism of claim 11, wherein:

said valve housing is of tubular configuration and permits positioning of said lower tubular section therein; and said at least one check valve comprises a pair of check valves spaced within said valve housing, each of said check valves normally arranged to permit direct circulating flow and to prevent reverse circulating flow and, when said lower tubular section is positioned within said valve housing being maintained at the open positions thereof.

13. The tubing connected check valve mechanism of claim 12, further comprising:

a tubular flow nipple defining the lower end of said tubular housing and having a closed end and defining an internal receptacle; and upon override disconnection of said lower tubular section from said upper tubular section, said lower tubular section being moved into said internal receptacle.

14. A tubing connected check valve mechanism for wells, selectively actuatable for direct circulation flow and reverse circulation flow, comprising:

a tubular housing having at least one check valve therein having a first valve position permitting only direct circulating flow therethrough and a second valve position permitting reverse circulating flow of fluid therethrough;

an inner tubular member linearly movable relative to said tubular housing and having a first position within said tubular housing permitting opening and closing of said at least one check valve and a second position within said tubular housing maintaining said at least one check valve open and permitting reverse flow circulation through said at least one check valve;

an actuating system for imparting upward and downward cycling movement of said inner tubular member relative to said tubular housing; and a position indexing mechanism located within said tubular housing and selectively actuatable to select check valve controlling positions of said inner tubular member relative to said tubular housing, wherein said actuating system comprises an actuator housing mounted to said inner tubular member;

an actuator ball seat defined within said inner tubular member;

an orifice defined within said actuator housing above said actuator ball seat; and an actuator ball located within said actuator housing and seated on said actuator ball seat responsive to direct circulating flow to permit flow only through said orifice and movable from said actuator ball seat responsive to reverse circulating flow further comprising a ball restraint element located within said actuator housing and limiting movement of said actuator ball away from said actuator ball seat by reverse circulating flow while permitting reverse circulating flow through said actuator ball seat.

15. The tubing connected check valve mechanism of claim 14, wherein:

said actuator housing defines an orifice mount; and further comprising an orifice fitting removably secured to said actuator housing by said orifice mount and defining said orifice.

16. The tubing connected check valve mechanism of claim 14, further comprising:

a tubular flow nipple mounted to the lower end of said tubular housing; and an internal boss projecting from said tubular flow nipple and defining an internal surface disposed in close clearance relation with said orifice when said inner tubular member is at said second position.

17. The tubing connected check valve mechanism of claim 14, further comprising:

a J-pin; and a J-slot mounted for rotation within said tubular housing and having a J-slot geometry engaged by said J-pin; and wherein responsive to linear upwardly and downwardly cycling movement of said inner tubular member, said J-pin tracks within said J-slot geometry and establishes a predetermined valve open position of said inner tubular member to permit direct and reverse circulating flow through said at least one check valve, and a valve enabled position of said inner tubular member permitting only direct circulating flow through said at least one check valve.

18. A tubing connected check valve mechanism for wells, selectively actuatable for direct circulation flow and reverse circulation flow, comprising:

a tubular housing having at least one check valve therein having a first valve position permitting only direct circulating flow therethrough and a second valve position permitting reverse circulating flow of fluid therethrough;

an inner tubular member linearly movable relative to said tubular housing and having a first position within said tubular housing permitting opening and closing of said at least one check valve and a second position within said tubular housing maintaining said at least one check valve open and permitting reverse flow circulation through said at least one check valve;

an actuating system for imparting upward and downward cycling movement of said inner tubular member relative to said tubular housing; and a position indexing mechanism located within said tubular housing and selectively actuatable to select check valve controlling positions of said inner tubular member relative to said tubular housing, wherein said actuating system comprises an actuator housing mounted to said inner tubular member;

an actuator ball seat defined within said inner tubular member;

an orifice defined within said actuator housing above said actuator ball seat; and an actuator ball located within said actuator housing and seated on said actuator ball seat responsive to direct circulating flow to permit flow only through said orifice and movable from said actuator ball seat responsive to reverse circulating flow, wherein said position indexing mechanism comprises:

a J-pin; and a J-slot sleeve mounted for rotation relative to said tubular housing and having a J-slot geometry engaged by said J-pin; and responsive to linear upwardly and downwardly cycling movement of said inner tubular member, said J-pin tracks within said J-slot geometry and establishes a predetermined valve open position of said inner tubular member to permit direct and reverse circulating flow through said at least one check valve and a valve enabled position permitting only direct circulating flow through said at least one check valve.

19. The tubing connected check valve mechanism of claim 18, wherein said actuating system comprises:

a compression spring urging said inner tubular member and said tubular housing to said first position;

a tubular flow member defining a lower end of said tubular housing and adapted for contact with material located within the well and for resisting further downward movement of said tubular housing within the well; and said compression spring deflecting in response to compression force application thereto and permitting movement of said inner tubular member to said second position relative to said tubular housing and upon dissipation of said compression force said compression spring returning said inner tubular member to said first position relative to said tubular housing.

20. A tubing connected check valve mechanism for wells, being selectively actuatable for direct circulation flow and reverse circulation flow, comprising:

a tubular housing having at least one check valve therein having a first valve position permitting only direct circulating flow therethrough and a second valve position permitting reverse circulating flow of fluid therethrough, said tubular housing having a lower end adapted for stopping engagement with material located within a well;

an inner tubular member connected to tubing extending from the surface and into the well and linearly movable relative to said tubular housing and having a first position within said tubular housing permitting opening and closing of said at least one check valve and a second position within said tubular housing maintaining said at least one check valve open and permitting reverse flow circulation through said at least one check valve;

a spring acting on said tubular housing and said inner tubular member and normally positioning said inner tubular member at said first position relative to said tubular housing; and a position indexing mechanism located within said tubular housing and being selectively actuated to select check valve controlling positions of said inner tubular member relative to said tubular housing.

21. The tubing connected check valve mechanism of claim 20, further comprising:

a tubular valve housing located within said tubular housing and having said at least one check valve supported for opening and closing movement therein, said tubular valve housing receiving a portion of said inner tubular member therein at said second position thereof, said portion of said inner tubular member securing said at least one check valve at said second position thereof.

22. The tubing connected check valve mechanism of claim 20, further comprising:

a tubular valve housing located within said tubular housing and supporting said at least one check valve for opening and closing movement therein;

said inner tubular member having a tubular lower section having releasable connection therewith, said tubular lower section located within said tubular valve housing at said second position and maintaining said least one check valve open and defining a reverse circulating flow path through said check valve mechanism;

an override seat defined within said lower tubular section;

an override ball dropped through said tubing and becoming seated on said override seat; and said releasable connection being released by downward force on said lower tubular section generated by fluid pressure from said tubing acting on said override ball and override seat, and when released said lower tubular section being moved downwardly to a position permitting restoring said check valve mechanism for direct circulating flow.

23. The tubing connected check valve mechanism of claim 20, further comprising:

a tubular lower section releasably connected to said inner tubular member;

a tubular valve housing located within said tubular housing and permitting positioning of said tubular lower section therein; and said at least one check valve being a pair of spaced check valves supported for open and closed positions within said tubular valve housing, each of said check valves being normally arranged to permit direct circulating flow and to prevent reverse circulating flow; and when said lower tubular section is positioned within said tubular valve housing said lower tubular section maintaining said pair of check valves open and defining a reverse circulating flow path through said valve mechanism.

24. The tubing connected check valve mechanism of claim 23, further comprising:

said tubular lower section being positioned within said tubular valve housing at said second position of said inner tubular member relative to said tubular housing;

at least one shear pin securing said tubular lower section to said inner tubular member;

a ball seat located within said tubular lower section and closed by an override ball to define a pressure responsive surface area, injected pressure through said tubing acting on said pressure responsive surface area and developing sufficient downwardly directed force on said tubular lower section to shear said at least one shear pin and release said tubular lower section for downward pressure responsive movement from said tubular valve housing to actuate said check valves for direct circulating flow only.

* * * * *